US010836594B2

(12) United States Patent
Shiozawa

(10) Patent No.: US 10,836,594 B2
(45) Date of Patent: Nov. 17, 2020

(54) SHEET FEEDING APPARATUS

(71) Applicant: CANON KABUSHIKI KAISHA, Tokyo (JP)

(72) Inventor: Misaki Shiozawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 52 days.

(21) Appl. No.: 16/140,909

(22) Filed: Sep. 25, 2018

(65) Prior Publication Data

US 2019/0100393 A1 Apr. 4, 2019

(30) Foreign Application Priority Data

Sep. 29, 2017 (JP) ..... 2017-190138

(51) Int. Cl.

| | |
|---|---|
| ***B65H 3/06*** | (2006.01) |
| ***B65H 7/20*** | (2006.01) |
| ***B65H 1/04*** | (2006.01) |
| ***B65H 7/02*** | (2006.01) |
| ***B65H 1/26*** | (2006.01) |

(52) U.S. Cl.

CPC ..... *B65H 3/0669* (2013.01); *B65H 1/04* (2013.01); *B65H 1/266* (2013.01); *B65H 7/02* (2013.01); *B65H 7/20* (2013.01); *B65H 2405/1118* (2013.01); *B65H 2513/10* (2013.01); *B65H 2513/53* (2013.01); *B65H 2515/32* (2013.01); *B65H 2515/704* (2013.01); *B65H 2801/06* (2013.01)

(58) Field of Classification Search

CPC ..... B65H 3/0669; B65H 2405/1118; B65H 3/5223; B65H 2515/704

See application file for complete search history.

(56) References Cited

U.S. PATENT DOCUMENTS

| | | | | |
|---|---|---|---|---|
| 6,786,481 | B2 * | 9/2004 | Kawai | B65H 3/0661 271/109 |
| 10,252,872 | B2 * | 4/2019 | Nishizawa | B65H 3/0669 |
| 2003/0184002 | A1 * | 10/2003 | Akiyama | B65H 3/0669 271/110 |
| 2016/0378042 | A1 * | 12/2016 | Tanaka | B65H 3/0661 271/10.03 |

FOREIGN PATENT DOCUMENTS

JP 2010-070281 A 4/2010

OTHER PUBLICATIONS

Muraki, "Tribology, Science of Friction and Lubrication Technology with Illustrations" (2007), Nikkan Kogyo Khimbun, LTD.

* cited by examiner

*Primary Examiner* — Howard J Sanders
(74) *Attorney, Agent, or Firm* — Venable LLP

(57) ABSTRACT

A sheet feeding apparatus includes a sheet stacking unit on which a sheet is stacked, a feed member configured to abut against the sheet stacked on the sheet stacking unit to feed the sheet, a friction member disposed on the sheet stacking unit so as to be opposed to the feed member; a drive unit configured to drive the feed member, a detection unit configured to detect a load on the drive unit when the drive unit drives the feed member, and a control unit configured to control the drive unit. The control unit causes the drive unit to drive the feed member at a first speed and thereafter in a case where the load detected by the detection unit satisfies a predetermined condition, the control unit causes the drive unit to drive the feed member at a second speed higher than the first speed.

8 Claims, 10 Drawing Sheets

SHEET FEEDING APPARATUS

BACKGROUND OF THE INVENTION

Field of the Invention

The present invention relates to a sheet feeding apparatus configured to feed sheets.

DESCRIPTION OF THE RELATED ART

A sheet feeding apparatus configured to feed sheets, which are stacked on a sheet stacking portion, one after another is used for image forming apparatus such as a copying machine, a printer, and a facsimile machine. In many cases, a friction force generated between a placement surface of the sheet stacking portion and a sheet is smaller than a friction force generated between sheets, and it has been known that a sheet (last sheet) in contact with the placement surface is liable to be conveyed together with a sheet stacked thereon.

In Japanese Patent Application Laid-Open No. 2010-70281, there is described a feeding apparatus in which a friction member is arranged at a position opposed to a feed roller on an upper surface of a bottom plate on which sheets are stacked. In order to prevent the last sheet from being fed together with a sheet stacked thereon, the friction member is configured to apply, to the last sheet, a friction force which is larger than a friction force generated between the sheets.

However, with the configuration described in Japanese Patent Application Laid-Open No. 2010-70281, at the time of feeding sheets, the friction force generated between the last sheet and the friction member and the friction force generated between sheets cause occurrence of a stick-slip phenomenon, with the result that noise is generated.

SUMMARY OF THE INVENTION

The present invention provides a sheet feeding apparatus configured to reduce generation of noise at the time of feeding sheets.

According to one embodiment of the present invention, there is provided a sheet feeding apparatus comprising:

a sheet stacking unit on which a sheet is stacked;

a feed member configured to abut against the sheet stacked on the sheet stacking unit to feed the sheet;

a friction member disposed on the sheet stacking unit so as to be opposed to the feed member;

a drive unit configured to drive the feed member;

a detection unit configured to detect a load on the drive unit when the drive unit drives the feed member; and a control unit configured to control the drive unit, so that the control unit causes the drive unit to drive the feed member at a first speed and thereafter in a case where the load detected by the detection unit satisfies a predetermined condition, the control unit causes the drive unit to drive the feed member at a second speed higher than the first speed.

According to another embodiment of the present invention, there is provided a sheet feeding apparatus comprising:

a sheet stacking unit on which a sheet is stacked;

a feed member configured to abut against the sheet stacked on the sheet stacking unit to feed the sheet;

a conveyance unit disposed downstream of the feed member in a conveyance direction of the sheet by the feed member and configured to convey the sheet;

a friction member disposed on the sheet stacking unit so as to be opposed to the feed member;

a drive unit configured to drive the feed member;

a detection unit configured to detect a load on the drive unit when the drive unit drives the feed member; and a control unit configured to control the drive unit, so that the control unit causes the drive unit to start to drive the feed member at a first drive force and thereafter in a case where the load detected by the detection unit satisfies a predetermined condition, the control unit sets a drive force given to the feed member by the drive unit to be smaller than the first drive force.

According to further another embodiment of the present invention, there is provided a sheet feeding apparatus comprising:

a sheet stacking unit on which a sheet is stacked;

a feed member configured to abut against the sheet stacked on the sheet stacking unit to feed the sheet;

a friction member disposed on the sheet stacking unit so as to be opposed to the feed member;

a drive unit configured to drive the feed member;

a detection unit configured to detect a load on the drive unit when the drive unit drives the feed member;

an adjustment unit configured to adjust an abutment pressure between the feed member and the sheet stacked on the sheet stacking unit; and a control unit configured to control the drive unit, so that the control unit causes the drive unit to start to drive the feed member in a state in which the feed member abuts against the sheet at a first abutment pressure and thereafter in a case where the load detected by the detection unit satisfies a predetermined condition, the control unit controls the adjustment unit so that the feed member is brought into a state in which the feed member abuts against the sheet at a second abutment pressure smaller than the first abutment pressure.

Further features of the present invention will become apparent from the following description of exemplary embodiments with reference to the attached drawings.

DESCRIPTION OF THE EMBODIMENTS

Figure 1:
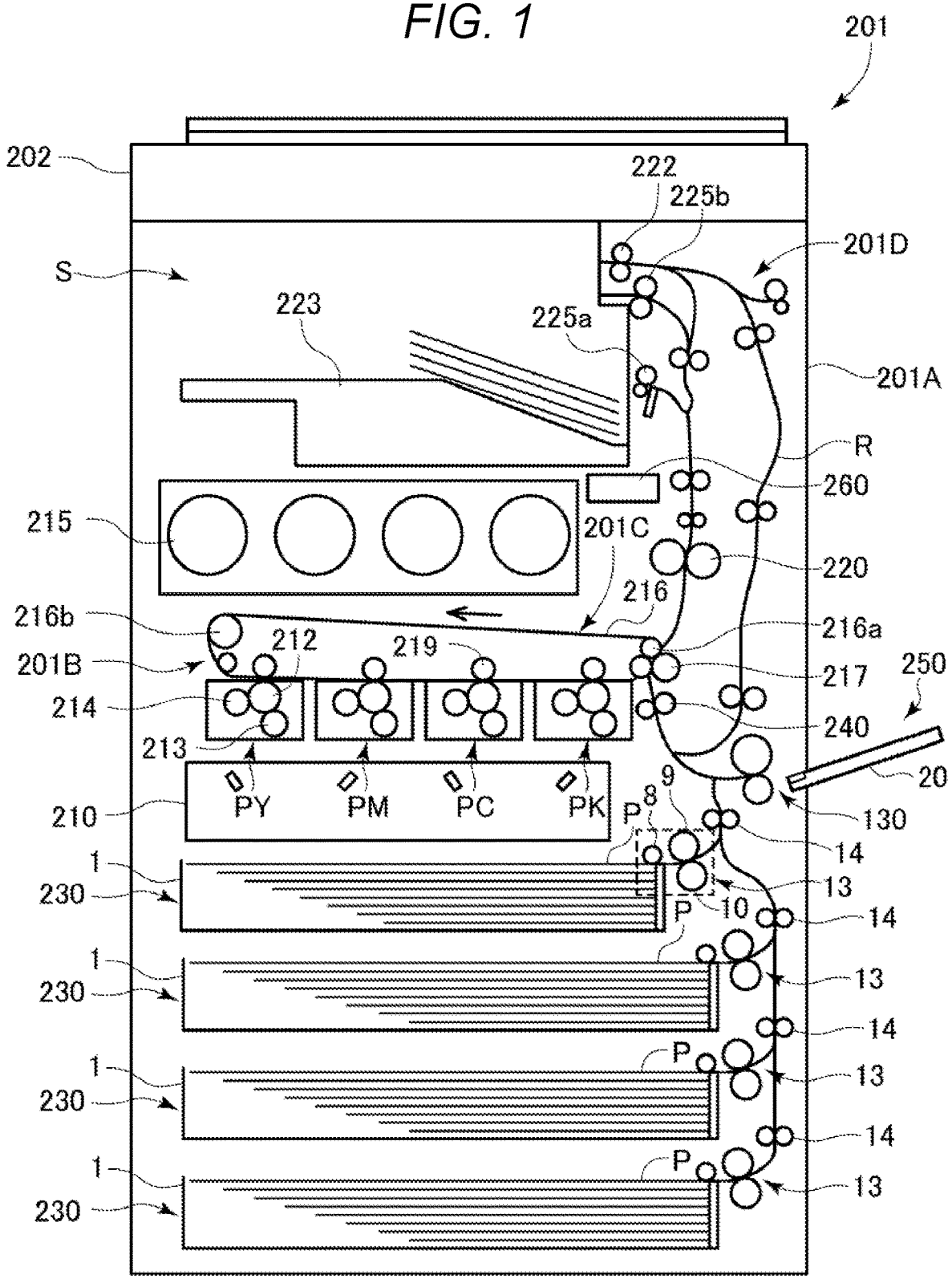
FIG. 1 is a schematic view of an image forming apparatus according to the present disclosure.

Now, a detailed description will be provided of embodiments of the present invention with reference to the drawings. FIG. 1 is a schematic view for illustrating an image forming apparatus 201 according to the present disclosure. An image forming portion 201B configured to form an image on a sheet is mounted to an image forming apparatus main body (hereinafter referred to as "apparatus main body") 201A. An image reading apparatus 202 is installed in a substantially horizontal posture on an upper side of the apparatus main body 201A. A delivery space S for sheet delivery is defined between the image reading apparatus 202 and the apparatus main body 201A.

In a lower part of the apparatus main body 201A, there are arranged a plurality of sheet feeding apparatus 230 each including a feed cassette 1 and a feed unit 13. The feed cassette 1 is configured to store sheets P. The feed unit 13 is configured to feed the sheets P from the feed cassette 1. The sheet P to be used as a recording medium may be, for example, paper such as normal paper and thick paper, special paper such as coated paper, a plastic film for an overhead projector, a cloth, and an envelope. Each feed unit 13 includes a pickup roller 8, a feed roller 9, and a retard roller 10. The pickup roller 8 is configured to send out the sheet P from the feed cassette 1. The feed roller 9 and the retard roller 10 are configured to separate and convey the sheet P sent out from the pickup roller 8.

The image forming portion 201B serving as an image forming unit is an electrophotographic unit of a 4-drum full-color type. That is, the image forming portion 201B includes a laser scanner 210 and four process cartridges PY, PM, PC, and PK configured to form toner images of four colors including yellow (Y), magenta (M), cyan (C), and black (K). Each of the process cartridges PY to PK includes a photosensitive drum 212 being a photosensitive member, a charger 213 being a charging unit, and a developing device 214 being a developing unit. Moreover, the image forming portion 201B includes an intermediate transfer unit 201C, which is arranged above the process cartridges PY to PK, and a fixing portion 220. Toner cartridges 215 configured to feed toner to the developing devices 214 are mounted above the intermediate transfer unit 201C.

The intermediate transfer unit 201C includes an intermediate transfer belt 216 which is stretched around a drive roller 216*a* and a tension roller 216*b*. On an inner side of the intermediate transfer belt 216, there are provided primary transfer rollers 219 which are held in abutment against the intermediate transfer belt 216 at positions opposed to the photosensitive drums 212. The intermediate transfer belt 216 is rotated in a counterclockwise direction in FIG. 1 by the drive roller 216*a* which is driven by a driver (not shown), and toner images each having a negative polarity borne on the photosensitive drums 212 are sequentially transferred in superimposition to the intermediate transfer belt 216 by the primary transfer rollers 219.

At a position opposed to the drive roller 216*a* of the intermediate transfer unit 201C, there is provided a secondary transfer roller 217 configured to transfer a color image borne on the intermediate transfer belt 216 to the sheet P. The fixing portion 220 is arranged above the secondary transfer roller 217. A first delivery roller pair 225*a*, a second delivery roller pair 225*b*, and a side reversing portion 201D are arranged above the fixing portion 220. The side reversing portion 201D includes, for example, a reverse roller pair 222 and a re-conveyance passage R. The reverse roller pair 222 is rotatable in forward and backward directions. The re-conveyance passage R is configured to allow a sheet having an image formed on one side to be conveyed again to the image forming portion 201B. Moreover, the image forming apparatus 201 includes a control portion 260 mounted thereto. The control portion 260 serves as a control unit (controller) configured to control, for example, an image forming operation and a sheet feeding operation.

Next, a description will be provided of the image forming operation of the image forming apparatus 201. Image information of an original is read by the image reading apparatus 202, and is subjected to image processing by the control portion 260. After that, the image information is converted into an electric signal and transferred to the laser scanner 210 of the image forming portion 201B. In the image forming portion 201B, a surface of each photosensitive drum 212 is uniformly charged to predetermined polarity and potential by the charger 213, and then is irradiated with laser light from the laser scanner 210. The drum surface is exposed to light along with rotation of the drum. With this, electrostatic latent images corresponding to single-color images of yellow, magenta, cyan, and black are formed on surfaces of the photosensitive drums 212 of the process cartridges PY to PK. Those electrostatic latent images are developed into visible images with toner of respective colors supplied from the developing devices 214, and then are primarily transferred in superimposition on one another from the photosensitive drums 212 to the intermediate transfer belt 216 by a primary transfer bias applied to the primary transfer rollers 219.

Simultaneously with such toner image forming operation, the sheets P are fed one after another from any one of the sheet feeding apparatus 230 and 250 to a registration roller pair 240. The registration roller pair 240 corrects skew feed of the sheet P, and thereafter sends out the sheet P toward the secondary transfer roller 217 in accordance with progress of the toner image formation by the image forming portion 201B. At a transfer portion (secondary transfer portion) formed between the secondary transfer roller 217 and the intermediate transfer belt 216, a full-color toner image is secondarily transferred to the sheet P in a collective manner by a secondary transfer bias applied to the secondary transfer roller 217. The sheet P having the toner image transferred thereto is conveyed to the fixing portion 220. Through melting and mixing of the toner of respective colors by heat and pressure applied in the fixing portion 220, the toner image is fixed on the sheet P as a color image.

After that, the sheet P is delivered to the delivery space S by the first delivery roller pair 225*a* or the second delivery roller pair 225*b*, which is provided downstream of the fixing portion 220, and is stacked on a stacking portion 223 arranged on a bottom portion of the delivery space S. When images are to be formed on both sides of the sheet P, the sheet P having an image formed on a first side is conveyed to the re-conveyance passage R under a state in which the sheet P is reversed front and back by the reverse roller pair 222, and is conveyed to the image forming portion 201B again. Then, the sheet P having an image formed on a second side by the image forming portion 201B is delivered to the stacking portion 223 by the first delivery roller pair 225*a* or the second delivery roller pair 225*b*.

The image forming portion 201B described above is an example of the image forming unit. Alternatively, an electrophotographic unit of a direct transfer type which is configured to directly transfer the toner image formed on the photosensitive member to the sheet may be used. Moreover, an image forming unit of an inkjet type or an offset print type may also be used.

First Embodiment

Next, a description will be provided of a sheet feeding apparatus according to a first embodiment of the present invention. As illustrated in FIG. 1, the sheet feeding apparatus 230 according to the first embodiment is assembled to the apparatus main body 201A of the image forming apparatus 201. That is, the feed unit 13 is supported on a frame body of the apparatus main body 201A, and the feed cassette 1 is inserted into the apparatus main body 201A so as to be drawable.

Figure 2:
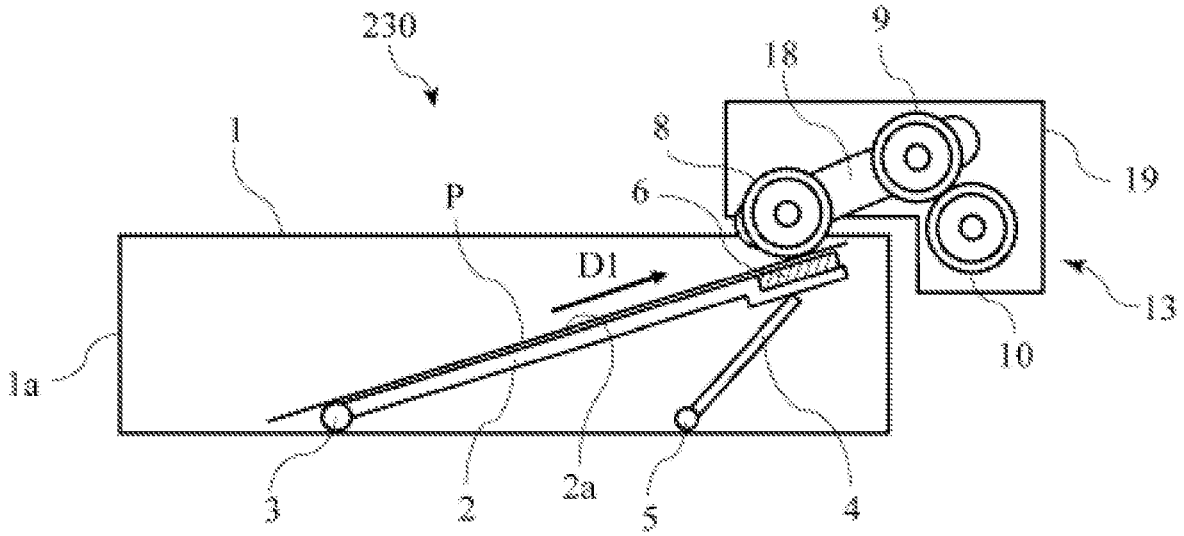
FIG. 2 is a schematic view of a sheet feeding apparatus according to a first embodiment of the present invention.

As illustrated in FIG. 2, the feed cassette 1 serving as a sheet stacking unit on which the sheets P are stacked includes a sheet stacking portion 2 which is turnable with respect to a cassette main body 1*a* in an up-and-down direction (vertical direction) about a turn shaft 3. An arm plate 4 which is turnably supported on the cassette main body 1*a* is arranged below the sheet stacking portion 2. The arm plate 4 is driven by a lifter motor M1 (see FIG. 3) to turn about a turn shaft 5. With this operation, the sheet stacking portion 2 is raised and lowered. In the sheet feeding apparatus 230, there is provided a height sensor which is configured to detect a height of an uppermost sheet of the sheets P stacked on the sheet stacking portion 2. When the sheet P is to be fed, based on a detection signal given by the height sensor, the lifter motor M1 is driven until the uppermost sheet reaches a predetermined height (height at which a feeding operation can be performed through abutment of the feed unit 13 against the uppermost sheet).

On an upper surface 2*a* being a placement surface of the sheet stacking portion 2, there is provided a friction member 6 at a position opposed to the pickup roller 8. That is, the friction member 6 is arranged at a position at which the sheets P are sandwiched between the pickup roller 8 and the friction member 6 under a state in which the pickup roller 8 is held in abutment against the uppermost sheet.

As described above, the feed unit 13 includes the pickup roller 8, the feed roller 9, and the retard roller 10. The pickup roller 8 and the feed roller 9 rotate along a sheet conveyance direction D1 by receiving a drive force transmitted from a drive unit such as a feed motor M2 (see FIG. 3). The retard roller 10 is mounted to a shaft, which does not rotate, through intermediation of a torque limiter under a state in which the feed roller 9 and the retard roller 10 are held in press-contact with each other. A portion at which the feed roller 9 and the retard roller 10 are held in press-contact with each other forms a separation nip portion for allowing the sheets P to be conveyed while being separated one after another.

The pickup roller 8 is rotatably held by a roller holder 18 being a holding member. The roller holder 18 is supported on the feed frame 19, which is fixed to a frame body of the apparatus main body 201A, under a state in which the roller holder 18 is swingable about the shaft of the feed roller 9. The pickup roller 8 is held in press-contact with an upper surface of the uppermost sheet having been raised to a predetermined height by own weight of, for example, the roller holder 18 and the pickup roller 8, or by the own weight of those and an urging force of a spring (not shown) which urges the roller holder 18 downward.

When feeding of the sheet P is to be performed, the pickup roller 8 and the feed roller 9 are driven to rotate by the drive force supplied from the feed motor M2 under a state in which the sheet P is held in abutment against the pickup roller 8 by the rising of the sheet stacking portion 2. With this, the uppermost sheet is sent out toward the separation nip portion by the pickup roller 8, and is conveyed toward the image forming portion 201B under a state in which the uppermost sheet is separated from other sheets by the feed roller 9 and the retard roller 10.

A description will be provided of a mechanism for separating a sheet at the separation nip portion. The feed roller 9 receives the drive of the feed motor M2 through a drive transmission mechanism such as a gear train so as to rotate in a rotation direction along the sheet conveyance direction D1. A torque which is to be input to the retard roller 10 by a friction force generated between the feed roller 9 and the retard roller 10 under a state in which the sheet P is not placed at the separation nip portion is represented by "Ta". Moreover, a torque which is to be input from the feed roller 9 to the retard roller 10 through intermediation of the sheet P by friction between the sheet P and each roller under the state in which only one sheet P has entered the separation nip portion is represented by "Tb". At this time, an allowable torque Tt1 of the torque limiter of the retard roller 10 is set so as to satisfy the following conditions (1) and (2).

$$Ta > Ttl \quad (1)$$

$$Tb > Ttl \quad (2)$$

When those conditions are satisfied, the torque limiter idles due to the excessive load, and the retard roller 10 rotates together with the feed roller 9 in the rotation direction along the sheet conveyance direction D1. Thus, when only one sheet P has entered the separation nip portion, the sheet P is conveyed in the sheet conveyance direction D1.

In contrast, when a torque which is to be input from the feed roller 9 to the torque limiter through intermediation of a plurality of sheets P under a state in which two or more sheets P have entered the separation nip portion is represented by "Tc", a magnitude of Tc is generally limited by the friction force generated between the sheets. The friction force generated between the sheets is affected by a material of the sheets (for example, whether or not the sheets have been subjected to surface treatment) or an atmosphere (for example, humidity). However, the allowable torque Tt1 of the torque limiter is set so as to satisfy the following condition (3) under a normal condition.

$$Tc < Ttl \quad (3)$$

When this condition is satisfied, the torque limiter does not idle, and the retard roller 10 remains being stopped without rotation with the feed roller 9. While the uppermost sheet is conveyed by the feed roller 9 in the sheet conveyance direction D1, the sheet which overlaps below the uppermost sheet is stopped by the retard roller 10 and slips with respect to the uppermost sheet, thereby preventing overlapped conveyance of the sheets P.

Next, a description will be provided of the friction member 6 mounted to the sheet stacking portion 2. The friction member 6 applies a friction force in a direction reverse to the sheet conveyance direction D1 with respect to a sheet that is to be fed last from the feed cassette 1, that is, a sheet held in contact with the upper surface 2*a* of the sheet stacking portion 2 (hereinafter referred to as "last sheet"). The friction member 6 satisfies the following condition (4) under a state in which a plurality of sheets P are stacked on the sheet stacking portion 2 and in which the pickup roller 8 is held in abutment against the uppermost sheet.

$$Fa>Fb \quad (4)$$

In the condition above, Fa represents a friction force received by the last sheet from the friction member 6 (maximum stationary friction force), and Fb represents a friction force received by the last sheet from a sheet overlapping thereon (maximum stationary friction force).

When this condition is satisfied, under a state in which the last sheet rests with respect to the friction member 6, the sheet overlapping the last sheet receives a tangential force larger than Fb from the pickup roller 8 to slip with respect to the last sheet. In other words, the friction member 6 prevents the last sheet from being fed by the pickup roller 8 together with the sheet stacked thereon, thereby being capable of improving anti-overlapped conveyance performance of the sheet feeding apparatus, that is, the ability to prevent overlapped conveyance of the sheet.

The pickup roller 8 and the friction member 6 are made of an elastic material (soft material) capable of being held in surface contact with a surface of the sheet P. The pickup roller 8 is made of a material such as ethylene propylene diene monomer (EPDM) rubber or polyurethane, and the friction member 6 is made of a material such as polyurethane resin or cork.

(Stick-Slip)

Now, a description will be provided of a stick-slip phenomenon which may occur on a contact surface between the friction member 6 and the last sheet or on a contact surface between sheets when feeding of the sheet is performed. When the stick-slip phenomenon occurs, the sheet and the pickup roller 8 vibrate, and such vibration may be amplified by, for example, the frame of the sheet feeding apparatus 230 to generate noise.

In general, the stick-slip phenomenon is more liable to occur when a coefficient of static friction between sliding objects is larger. Moreover, it has been known that, when a relative movement speed between objects (sheet conveyance speed in the first embodiment) is lower, a stick state becomes longer to increase the stationary friction force, with the result that the stick-slip phenomenon is more liable to occur. For example, see "Tribology, Science of Friction and Lubrication Technology with Illustrations" Masayoshi MURAKI (2007), published by NIKKAN KOGYO SHIMBUN, LTD.

Thus, for prevention of the stick-slip phenomenon, it is effective to set a sheet conveyance speed (feeding speed) at the time of feeding a sheet to be higher. However, when the feeding speed is to be increased, it is required to consider degradation in anti-overlapped conveyance performance. The reason is as follows. Sheets having reached the separation nip portion under the state in which a plurality of sheets are overlapping (overlapped conveyance state) are separated by actions of the feed roller 9 and the retard roller 10. At this time, as the feeding speed is higher, the rotation speed of the feed roller 9 and the rotation speed of the retard roller 10 rotated by the feed roller 9 under the state in which the sheet is not present at the separation nip portion become higher. Therefore, when the sheets in the overlapped conveyance state reaches the separation nip portion, the retard roller 10 cannot immediately stop its rotation due to an inertia force acting on the retard roller 10, with the result that the sheet may be allowed to pass in the overlapped conveyance state. When the sheets in the overlapped conveyance state reach conveyance members (for example, conveyance roller pair 14 in FIG. 1) downstream of the separation nip portion, or a sheet position at the time of starting the next sheet feeding operation is shifted, a conveyance abnormality such as a jam (sheet jam) may occur.

In view of the circumstance described above, it is conceivable to switch between a state in which the feeding speed is set relatively low and a state in which the feeding speed is set relatively high in accordance with the magnitude of the stationary friction force generated between a sheet to be fed and a member to be brought into contact with the sheet. Then, when the feeding speed is set to be high only in a case in which the friction between the sheet and the member brought into contact with the sheet is large, the stick-slip phenomenon can be prevented to reduce generation of noise while suppressing the degradation in anti-overlapped conveyance performance to be minimum. Now, a description will be provided of a control method for the sheet feeding operation in the first embodiment.

Figure 3:
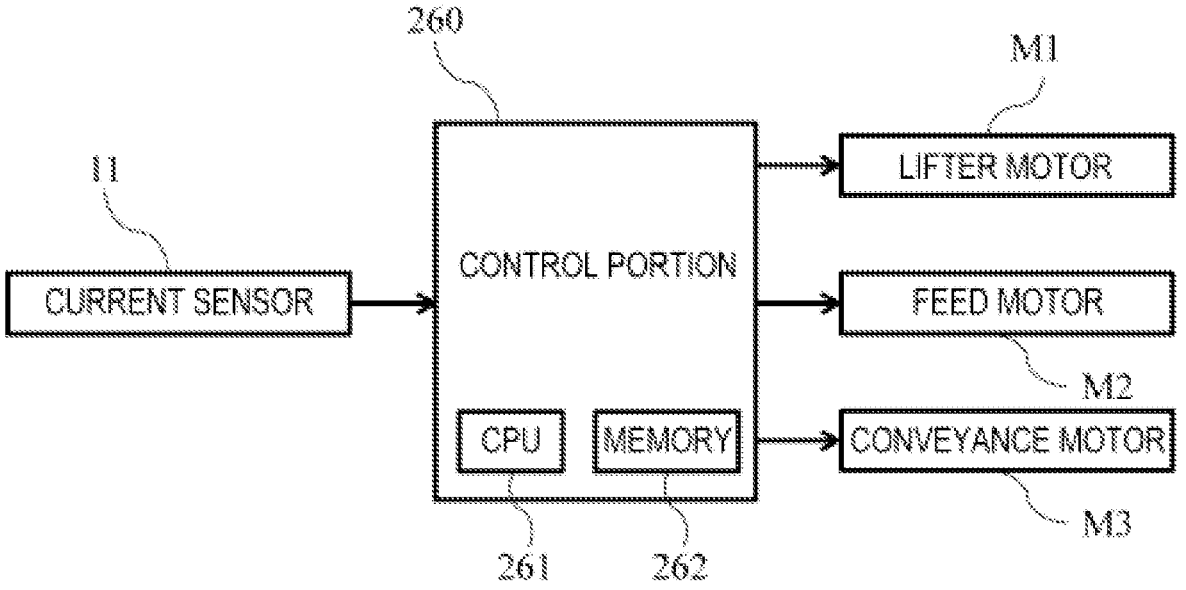
FIG. 3 is a block diagram for illustrating a control configuration for the sheet feeding apparatus according to the first embodiment.

As illustrated in FIG. 2 and FIG. 3, the sheet feeding apparatus 230 includes a current sensor 11 serving as a detection unit configured to detect a load to be applied at the time of driving a feed member. The current sensor 11 is connected to the control portion 260 mounted to the image forming apparatus 201, and the control portion 260 is configured to control drive states of the lifter motor M1 and the feed motor M2 based on a detection result of the current sensor 11. The control portion 260 is one example of a control unit configured to control the sheet feeding apparatus, and includes a memory 262 and a central processing unit (CPU) 261. The memory 262 serves as a storage portion configured to store a control program and information such as an attribute of a sheet. The CPU 261 is configured to read a program from the memory 262 and execute the program.

Figure 4:
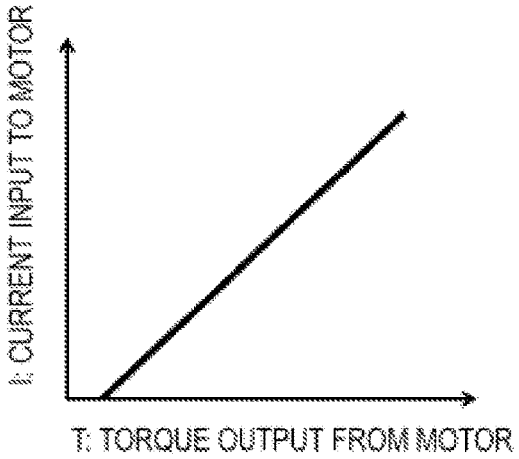
FIG. 4 is a graph for showing a relationship between an input current and an output torque of a motor.

The current sensor 11 is an ammeter configured to detect a magnitude of a current supplied to a winding of the feed motor M2 from a drive circuit configured to drive the feed motor M2. In general, torque to be output from the motor is determined by a current value to be input. In a case of a DC motor as an example, as illustrated in FIG. 4, the output torque is proportional to the input current. The control portion 260 measures a current value of the feed motor M2 to calculate torque output from the feed motor M2, and determines whether or not torque equal to or larger than a predetermined value is required for conveyance of the sheet P by the pickup roller 8. At this time, if a conveyance force with torque (pickup roller 8) equal to or larger than the predetermined value is required, it is determined that the coefficient of static friction between the sheet P and a member in contact with the sheet P is so large that the stick-slip phenomenon may occur.

After feeding of the sheet at a low speed (first speed) is started, the control portion 260 receives a detection signal from the current sensor 11, and determines based on the detection signal whether or not it is required to prevent occurrence of the stick-slip phenomenon. When the drive load of the feed motor M2 becomes equal to or larger than a predetermined value, the control portion 260 switches the feeding speed of the sheet to a high speed (second speed) in order to prevent the stick-slip phenomenon. The high feeding speed is a speed which is set so as to prevent occurrence of the stick-slip phenomenon between the sheet and the friction member 6, and detailed description thereof is made later.

Figure 5:
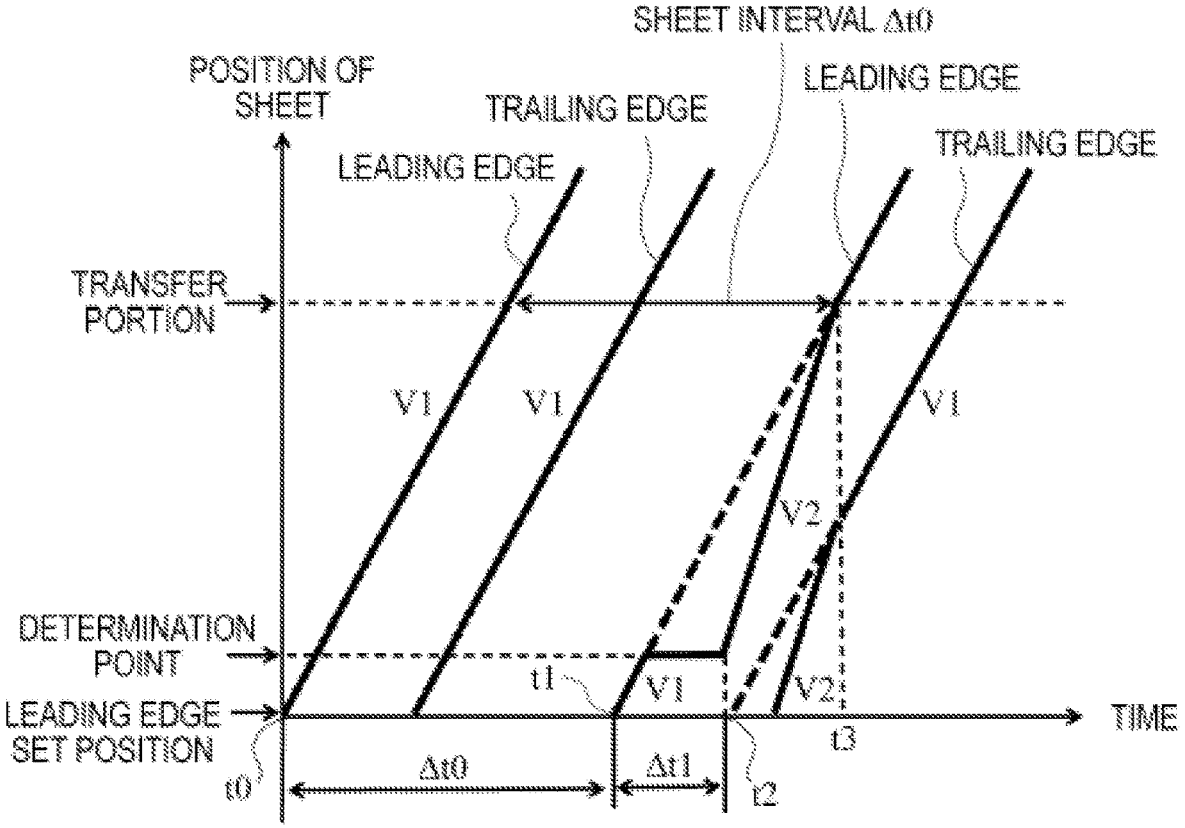
FIG. 5 is a diagram for illustrating conveyance of sheets by a sheet feeding operation in the first embodiment.

Now, a description will be provided of a method of maintaining an appropriately sheet-to-sheet distance between a preceding sheet and a succeeding sheet when the feeding speed of one sheet (succeeding sheet) is switched from the low speed to the high speed. In FIG. 5, the vertical axis represents positions of a leading edge and a trailing edge of a sheet, that is, positions of a downstream edge and an upstream edge in a conveyance direction of the sheet, and the horizontal axis represents time. The feeding speed of the preceding sheet and the succeeding sheet at the time of starting feeding is represented by V1, and the feeding speed of the succeeding sheet given when the feeding speed is switched to the high speed is represented by V2. Moreover, a feed interval between the preceding sheet and the succeeding sheet is represented by Δt0. The feed interval is a time interval between a time point at which feeding of the preceding sheet is started by the pickup roller 8 so that the leading edge thereof starts moving from a leading edge set position of the feed cassette 1 and a time point at which the leading edge of the succeeding sheet starts moving from the leading edge set position. The feeding speeds V1 and V2 satisfy the following relationship.

$$V1<V2 \tag{5}$$

When the sheet is conveyed at the feeding speed V2, the stick-slip phenomenon does not occur on a contact surface between a last sheet and the friction member 6 or on a contact surface between the preceding sheet and the succeeding sheet.

It is preferred that, regardless of whether or not the feeding speed of the succeeding sheet (second sheet) is switched, the time interval between entry of the preceding sheet (first sheet) into the transfer portion and entry of the succeeding sheet into the transfer portion be constant (Δt0). Moreover, it is preferred that, regardless of presence or absence of the switching of the feeding speeds, the conveyance speed of the sheet at the transfer portion be constant (V1). This is for the purpose of preventing influence such as image density unevenness on sheets by performing image formation under a condition that is as even as possible.

After feeding of the preceding sheet at the speed V1 is started on a time t0, feeding of the succeeding sheet at the speed V1 is started on a time t1 after elapse of a time period Δt0 (first time period) from the time t0. The control portion 260 determines, with use of the current sensor 11, whether or not the drive load of the feed motor M2 has become equal to or larger than a predetermined value before the leading edge of the succeeding sheet reaches a preset position (determination point). The determination point is set as close as possible to the sheet leading edge set position, and a distance from the sheet leading edge set position to the determination point is set so as to be larger than a distance by which the sheet proceeds within a time period from the start of feeding (t1) to processing of the output of the current sensor 11. That is, setting is made so that the sheet is prevented from passing through the determination point before the output from the current sensor 11 is processed.

When the drive load of the feed motor M2 has not exceeded the predetermined value during a period until the succeeding sheet reaches the determination point, switching of the feeding speed of the succeeding sheet is not performed, and the feeding is continued at the constant speed V1 (see the broken line). In this case, the time interval (Δt0) and the sheet conveyance speed (V1) of the sheets at the transfer portion are maintained constant by continuing the conveyance of the sheet at the speed V1.

Meanwhile, when it is detected that the drive load of the feed motor M2 becomes equal to or larger than the predetermined value, conveyance of the succeeding sheet is paused at the time point at which the leading edge of the succeeding sheet has reached the determination point. After that, at a time t2 after elapse of Δt1 from the time t1 at which the feeding of the succeeding sheet is started, the feeding speed is switched to V2, and the feeding of the succeeding sheet is restarted. Further, at a time t3 at which the leading edge of the succeeding sheet enters the transfer portion, control of switching the speed to V1 is performed again. A length of a waiting time (Δt1) until the restart of the conveyance of the sheet is set so that the sheet reaches the transfer portion at substantially the same time (t3) as the case in which the conveyance of the sheet is continued at the speed V1 (broken line). Through such control, even in the case in which the switching of the feeding speed of the succeeding sheet is performed, the succeeding sheet can be fed to the transfer portion at the time interval of Δt0 with respect to the preceding sheet and at the same sheet conveyance speed (V1) as the preceding sheet.

Next, a description will be provided of a method of determining the speed V2 which does not cause the stick-slip mentioned above. Based on studies of tests and the like, it has been found that factors which may affect presence or absence of occurrence of the stick-slip phenomenon with regard to the sheet feeding apparatus mainly include the rigidity of the feed frame 19 and a damping coefficient of the roller holder 18 configured to hold the pickup roller 8. The rigidity of the feed frame 19 is calculated, for example, by a method of calculating the rigidity with use of a structure analysis software based on the amount of deformation of the frame given when a force assuming the feeding is applied. The damping coefficient is defined as a logarithm of a ratio of amplitudes of adjacent peaks of vibration when an object is freely vibrated. In other words, the damping coefficient is a coefficient which expresses to what degree the vibration of an object can easily be damped. The damping coefficient of the roller holder 18 can be calculated by performing, for example, a hammering test.

Figure 6A:
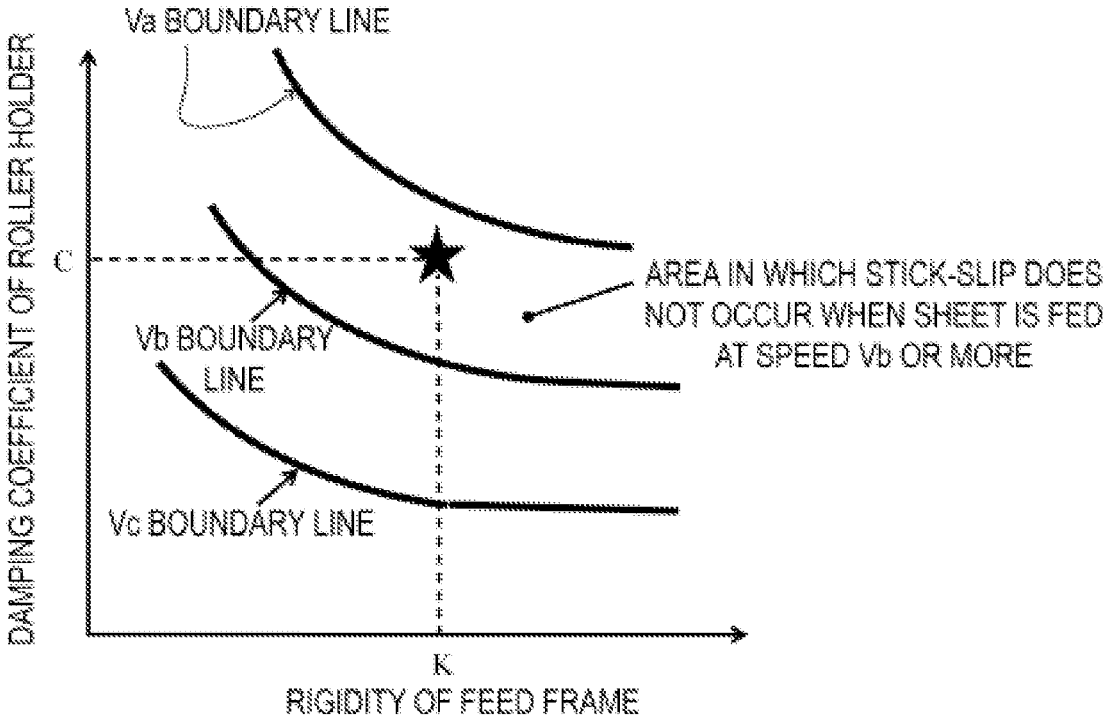
FIG. 6A is a graph for showing a relationship between a sheet conveyance speed and a stick-slip phenomenon when a coefficient of static friction between a sheet and a friction member is large.
Figure 6B:
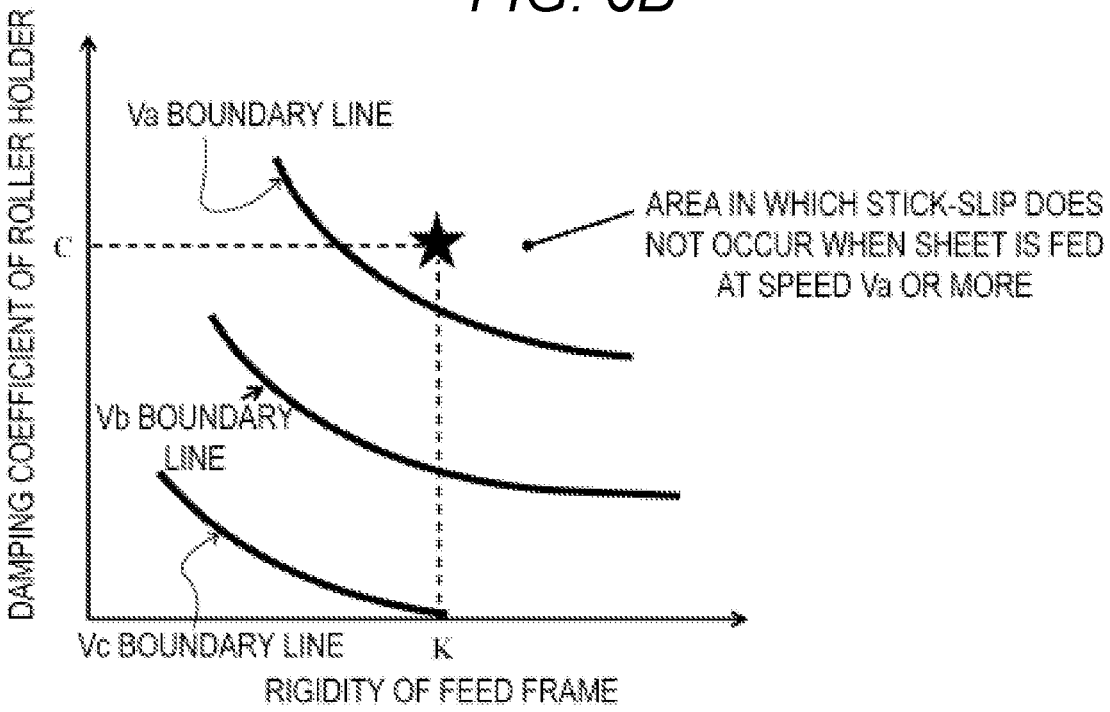
FIG. 6B is a graph for showing a relationship between the sheet conveyance speed and the stick-slip phenomenon when the coefficient of static friction between the sheet and the friction member is small.

In FIG. 6A and FIG. 6B, the vertical axis represents a damping coefficient of the roller holder 18, and the horizontal axis represents the rigidity of the feed frame 19. The star mark represents the rigidity K of the feed frame 19 and the damping coefficient C of the roller holder 18 in one sheet feeding apparatus, which are plotted on the graph. FIG. 6A corresponds to a case in which the coefficient of static friction of the friction member 6 with respect to the sheet is μ1, and FIG. 6B corresponds to a case in which the coefficient of static friction of the friction member 6 with respect to the sheet is μ2. It is defined that μ1 and μ2 satisfy the relationship of μ1>μ2. As described above, the feeding speed of the sheet affects the possibility of causing the stick-slip phenomenon. Therefore, when boundary lines each dividing a region which causes the stick-slip and a region which does not cause the stick-slip are calculated for freely-selected feeding speeds Va, Vb, and Vc based on information including the mass of the sheet feeding apparatus, the rigidity, the damping coefficient, and the friction coefficient of the friction member, the curves illustrated in FIG. 6A and FIG. 6B are depicted. It is defined that the relationship of Va<Vb<Vc be satisfied.

In FIG. 6A, the plot (star mark) of the rigidity K and the damping coefficient C of one sheet feeding apparatus is located in a region on an upper right side from the Vb boundary line and on a lower left side of the Va boundary line. That is, it can be understood that, in a case in which a sheet is to be fed by this sheet feeding apparatus, the stick-slip may occur when the feeding speed is Va, and the stick slip may not occur when the feeding speed is equal to or larger than Vb. Thus, even in a case in which the stick-slip occurs when the feeding speeds V1 and V2 of the sheet are uniformly set to Va, occurrence of the stick-slip can be suppressed by setting the feeding speed V2 of the sheet to the speed Vb.

Meanwhile, in FIG. 6B, the boundary lines of Va to Vc are shifted to a lower left side, and hence it can be understood that the stick-slip is less liable to occur as compared to the case illustrated in FIG. 6A even when the feeding speed is constant. In this case, even when the feeding speed of the sheet is always set to Va, generation of noise due to the stick-slip is less liable to occur. However, when the sheet is to be fed at a speed lower than Va (for example, a thick sheet having a large heat capacity is required to pass through the fixing portion of a thermal fixing type at low speed), for example, it is conceivable to set V2=Va and set V1 to a value smaller than Va.

For a model with productivity set to 45 sheets per minute, the speeds V1 and V2 are set to, for example, V1=200 [mm/s] and V2=300 [mm/s]. As a matter of course, values of V1 and v2 are suitably changed in accordance with a configuration of the sheet feeding apparatus (plot positions on the graph) and required productivity.

(Control of Feed Task)

Figure 7:
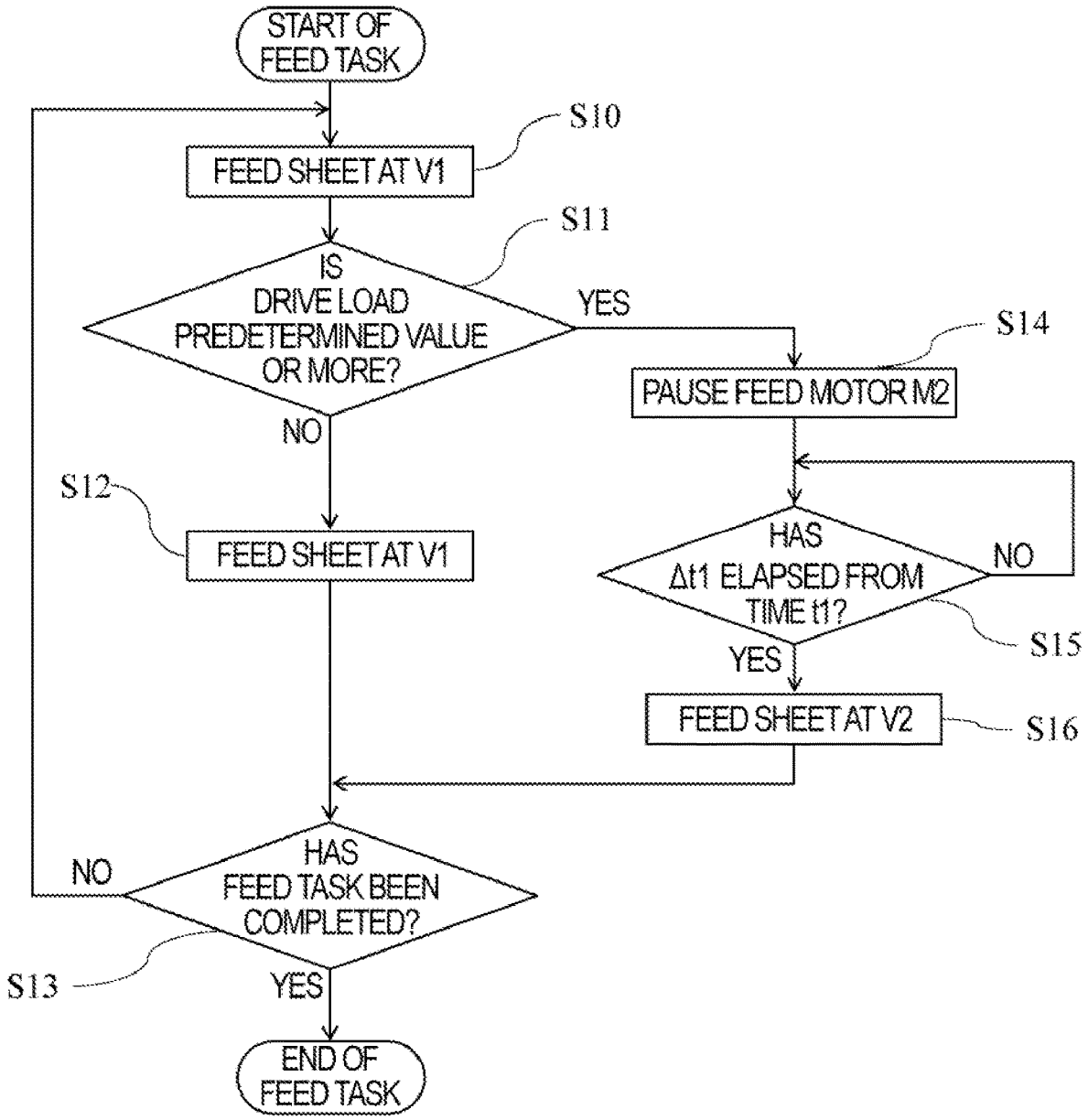
FIG. 7 is a flowchart for illustrating a control method for a sheet feeding operation in the first embodiment.

Next, with reference to a flowchart illustrated in FIG. 7, a description will be provided of a control method for a feed task in the first embodiment. When a signal for requesting output of an image (image forming job) is input to the image forming apparatus, the control portion 260 starts a feed task for a sheet to feed a sheet required for execution of the image forming job. First, after feeding of the sheet at the speed V1 is started (Step S10), the control portion 260 determines whether or not the drive load of the feed motor M2 has exceeded a predetermined value before the sheet reaches the determination point described above (Step S11). As described above with reference to FIG. 6A and FIG. 6B, the predetermined value is set based on whether or not the coefficient of static friction between a sheet to be fed and a sheet in contact with this sheet or the friction member 6 has a magnitude which causes the stick-slip when the feeding at the speed V1 is continued.

When the drive load does not exceed the predetermined value (NO in Step S11), the feeding of the sheet is continued at the speed V1 (Step S12). After that, determination is made on whether or not the feed task has been completed (Step S13). When the feed task has been completed, the operation is stopped (YES in Step S13). When the feed task has not been completed, processing for the next sheet is started (NO in Step S13).

When it is determined that the drive load is at the predetermined value or more (YES in Step S11), the control portion 260 pauses the feed motor M2 at the time point at which the sheet has reached the determination point (Step S14), and waits until a time period of Δt1 elapses from the feeding start time t1 (NO in Step S15). Then, when the elapsed time exceeds Δt1 (YES in Step S15), the feeding speed is changed to V2, and the feeding of the sheet is restarted (Step S16). After that, determination is made of whether or not the feed task has been completed (Step S13). When the feed task has been completed, the operation is stopped (YES in Step S13). When the feed task has not been completed, processing for the next sheet is started (NO in Step S13).

As described above, in the first embodiment, after feeding of the sheet is started at the first speed (V1), when the drive load of the feed motor satisfies a predetermined condition based on a detection result of the current sensor 11, the feeding speed is switched to the second speed (V2) higher than the first speed. The predetermined condition is a condition which indicates necessity for preventing occurrence of the stick-slip. In the first embodiment, it is determined that the condition is satisfied when the drive load is at the predetermined value or more. With this, generation of noise due to the stick-slip phenomenon at the time of feeding the sheet can be reduced. Moreover, when the condition is not satisfied, feeding of the sheet is performed at the first speed, thereby being capable of suppressing degradation of the anti-overlapped conveyance performance to minimum.

Moreover, in the first embodiment, when the switching of the feeding speed is to be performed, control is executed so as to pause the feed motor M2 and thereafter restart the drive of the feed motor M2 at the speed V2 obtained after switching (see FIG. 5). With this, the difference between the feeding speeds V1 and V2 is cancelled out by the pausing operation. Thus, the sheet interval at the transfer portion can be maintained at a substantially constant interval (Δt0) which is suitable for allowing the image forming portion 201B to stably form high-quality images.

Modification Example

Figure 8A:
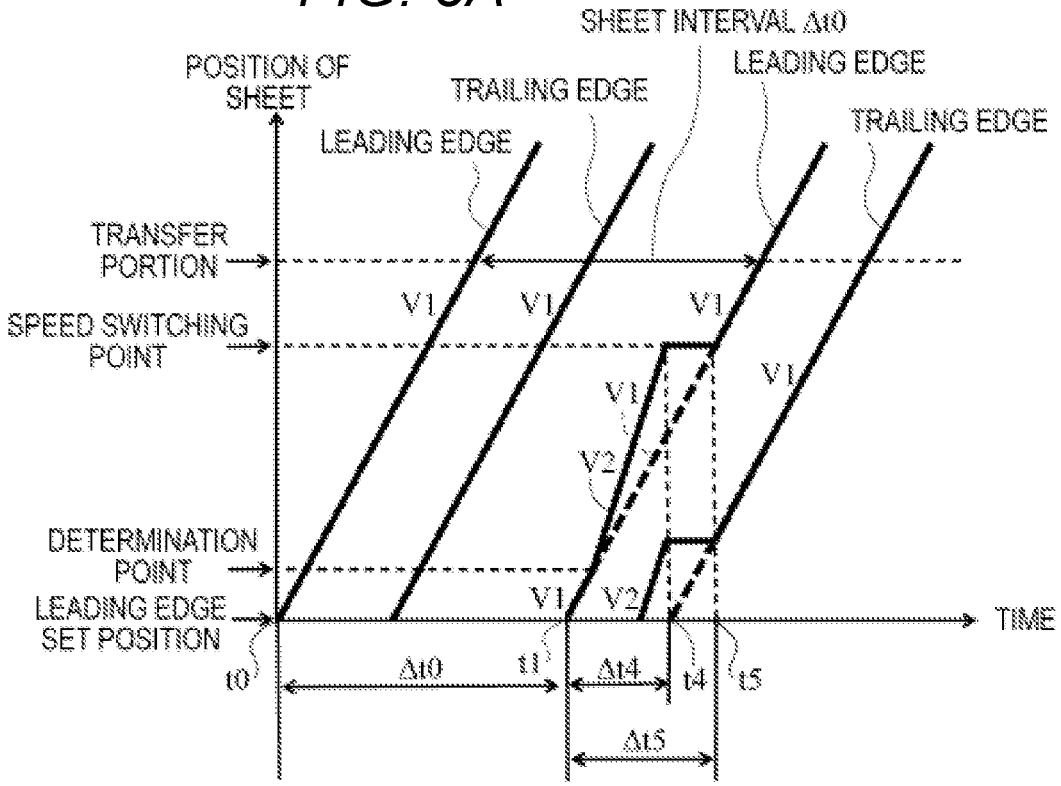
FIG. 8A and FIG. 8B are diagrams for illustrating modification examples of a control method for the conveyance speed during the sheet feeding operation.
Figure 8B:
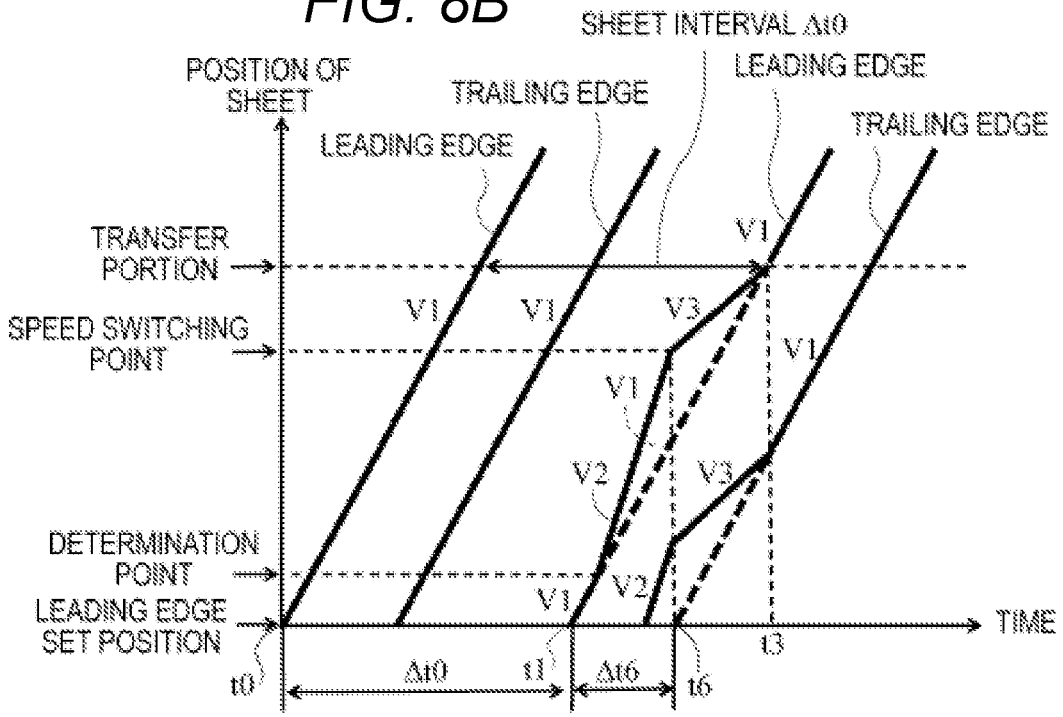

In the first embodiment described above, the feeding speed of the sheet is controlled along the chart illustrated in FIG. 5. However, the feeding speed can be controlled also by a different method. Examples thereof are illustrated in FIG. 8A and FIG. 8B. In the example illustrated in FIG. 8A, after the feeding of the succeeding sheet is started at the time t1, when the drive load of the feed motor M2 is at the predetermined value or more, the speed is switched to V2, and the feeding is continued. After that, conveyance of the sheet is paused from a time t4 after elapse of a time period of Δt4 from the start of feeding, and the conveyance of the sheet is restarted at the speed V1 at a time t5 after elapse of a time period of Δt5 from the time t1. Moreover, in the example illustrated in FIG. 8B, after the feeding of the succeeding sheet is started at the time t1, when the drive load of the feed motor M2 is at the predetermined value or more, the speed is switched to V2, and the feeding is continued. After that, at a time t6 after elapse of a time period of Δt6 from the start of feeding, the conveyance speed of the sheet is reduced to V3. Then, at a time t3 at which the leading edge of the sheet reaches the transfer portion, the conveyance speed is switched to V1. The speeds V1, V2, and V3 satisfy the following expression (6).

$$V2>V1>V3 \tag{6}$$

In any of the examples in FIG. 8A and FIG. 8B, the conveyance speed of the sheet is switched before the leading edge of the sheet reaches a predetermined position (transfer portion herein), and there is provided a period in which the speed is lower than the speed V1 (including the case in which the speed is zero). As described above, even when the method of reducing the conveyance speed of the sheet in the middle is employed in place of the method of switching the feeding speed to V2 after pausing the feeding of the sheet as in the first embodiment, the interval and the conveyance speed of the sheet at the predetermined position can be maintained constant. In the first embodiment, control is performed so that the interval of the sheets at the transfer portion (secondary transfer portion) is set constant. However, in the case of the sheet feeding apparatus configured to feed the sheet to another part in the image forming apparatus, a target position (predetermined position) for maintaining the constant sheet interval is replaced. For example, in the case of the sheet feeding apparatus configured to feed the sheet being the original in the image reading apparatus 202 (see FIG. 1), it is preferred that the interval and the conveyance speed of the sheet at the reading position at which the sheet is scanned by the reading unit be constant.

Figure 9:
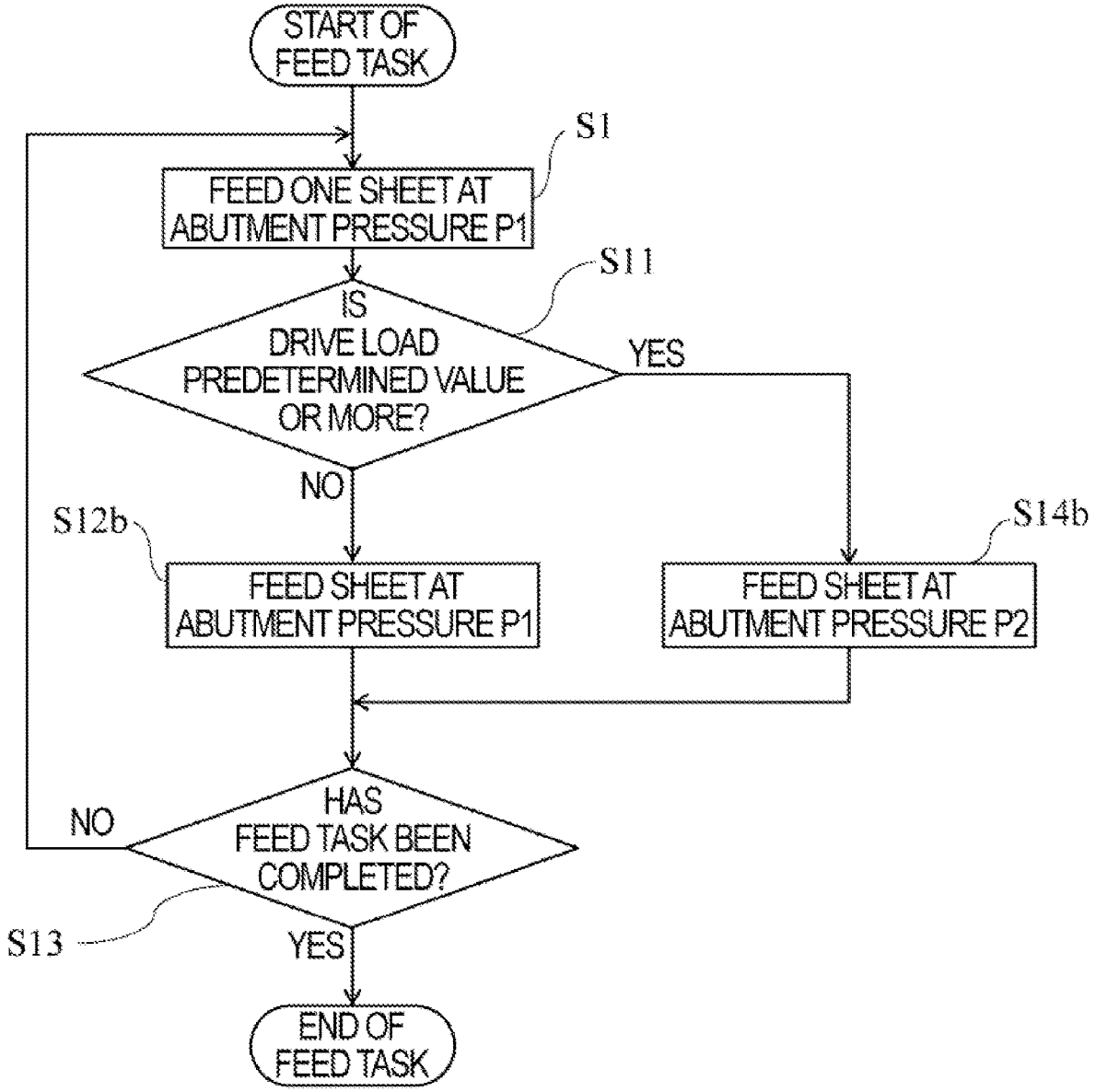
FIG. 9 is a flowchart for illustrating a modification example of the control method for the sheet feeding operation.

Moreover, in the first embodiment described above, occurrence of the stick-slip phenomenon is suppressed by increasing the conveyance speed of the sheet. However, it has been known that reduction in load generated on contact surfaces of objects is also effective for suppression of the stick-slip phenomenon. In view of this, as illustrated in FIG. 9, one sheet is fed at an abutment pressure P1 (Step S1). In FIG. 9, steps which are the same as the steps illustrated in FIG. 7 are denoted by the same reference symbols, and description thereof is omitted. When the drive load of the feed motor M2 is at the predetermined value or more (YES in Step S11), a method of reducing the abutment pressure between the pickup roller 8 and the sheet may be used (Step S14*b*). In FIG. 9, an abutment pressure P2 (second abutment pressure) (Step S14*b*) given when the drive load of the feed motor M2 is at the predetermined value or more (YES in Step S11) is set so as to be smaller than the abutment pressure P1 (first abutment pressure) (Step S12*b*) given when the drive load does not exceed the predetermined value (NO in Step S11). In this case, the abutment pressure between the pickup roller 8 and the sheet can be adjusted, for example, by controlling an angle of the arm plate 4 (see FIG. 2) by the lifter motor M1. The arm plate 4 is an example of an adjustment unit configured to adjust the abutment pressure, and a cam mechanism or a solenoid configured to swing the roller holder 18 may be arranged.

When the abutment pressure P of the pickup roller 8 with respect to the sheet is set small, the friction force generated between the sheet and the friction member 6 or between the sheet and another sheet underlying therebelow is reduced. Thus, occurrence of the stick-slip phenomenon is suppressed. Meanwhile, the abutment pressure P1 given when the drive load of the feed motor M2 does not exceed the predetermined value is set to a value larger than P2 so that the pickup roller 8 can reliably feed the sheet. In the example illustrated in FIG. 9, the abutment pressure P2 given when the drive load of the feed motor M2 exceeds the predetermined value is maintained constant. However, as a mode of reducing the abutment pressure, the abutment pressure may be set to zero. In that case, for example, it is conceivable to employ a method of separating the pickup roller 8 from the sheet after the sheet has reached the separation nip portion.

The pickup roller 8 in the first embodiment described above is an example of the feed member configured to feed the sheet from the sheet stacking unit. For example, the pickup roller 8 may be omitted, and the feed roller 9 may be directly brought into abutment against the sheet stacked on the sheet stacking portion 2 to feed the sheet. Even in such a case, the same effect as the first embodiment can be attained by switching the feeding speed in accordance with the drive load of the drive unit configured to drive the feed roller 9 and suitably setting the feeding speed in accordance with a configuration of the sheet feeding apparatus. Moreover, in the first embodiment, the drive force is not transmitted to the retard roller 10. However, the retard roller 10 may be connected to a drive force (see FIG. 2) so that a drive force in a direction of returning the sheet P (direction reverse to the sheet conveyance direction D1) is input. Moreover, a pad member may be used as the separation member in place of the roller member to allow the sheet conveyed by the feed roller 9 to be separated from another sheet.

Second Embodiment

Next, a description will be provided of a second embodiment of the present invention. In the first embodiment described above, the operation for preventing the stick-slip phenomenon is performed when the drive load of the feed motor M2 exceeds the predetermined value. However, in the second embodiment, occurrence of the stick-slip phenomenon is detected based on fluctuation in drive load. Moreover, in the first embodiment, switching of the feeding speed is performed to reduce occurrence of noise due to the stick-slip phenomenon. However, in the second embodiment, occurrence of noise is reduced by reducing the drive force input to the pickup roller 8. In the following, components which are in common with the first embodiment are denoted by the same reference symbols as those of the first embodiment, and description thereof is omitted.

Figure 10:
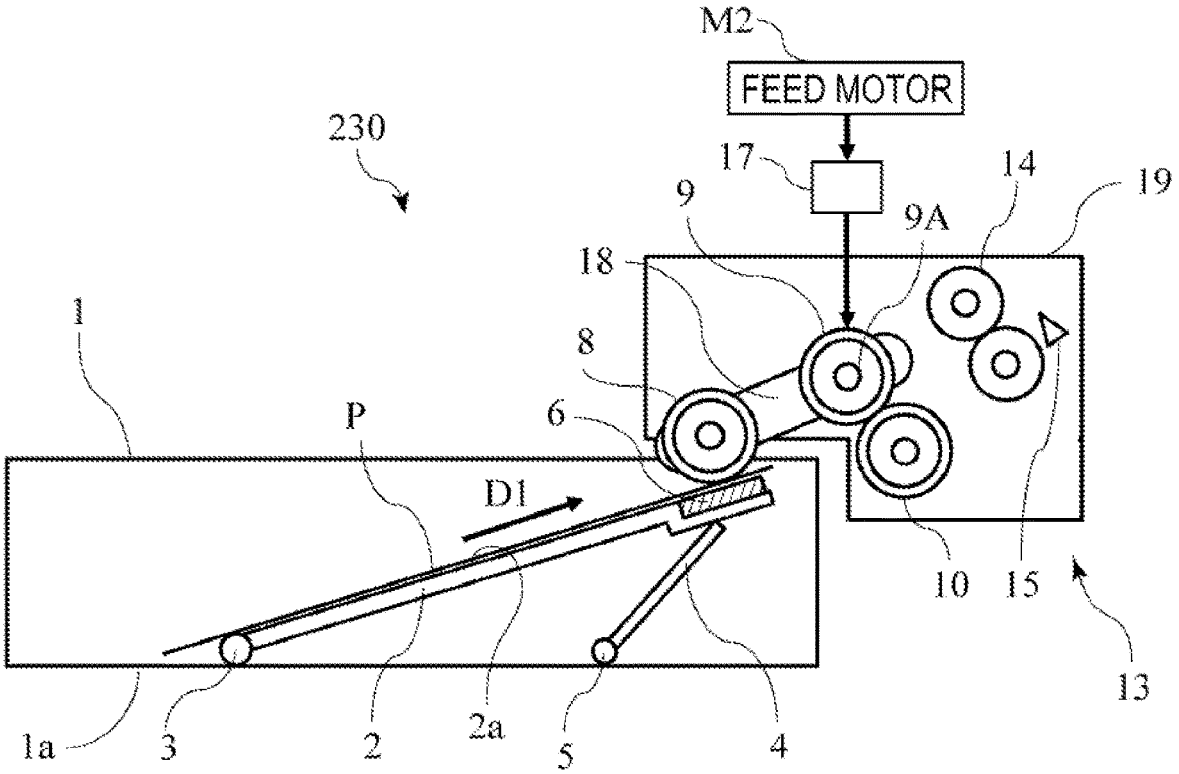
FIG. 10 is a schematic view of a sheet feeding apparatus according to a second embodiment of the present invention.

FIG. 10 is an explanatory schematic view for illustrating a configuration of a sheet feeding apparatus 230 according to the second embodiment. The sheet feeding apparatus 230 includes a feed cassette 1 and a feed unit 13. The feed cassette 1 serves as a sheet stacking unit. The feed unit 13 includes the pickup roller 8 which serves as a feed member. The friction member 6 is arranged at a position opposed to the pickup roller 8 on the sheet stacking portion 2 of the feed cassette 1.

Figure 12:
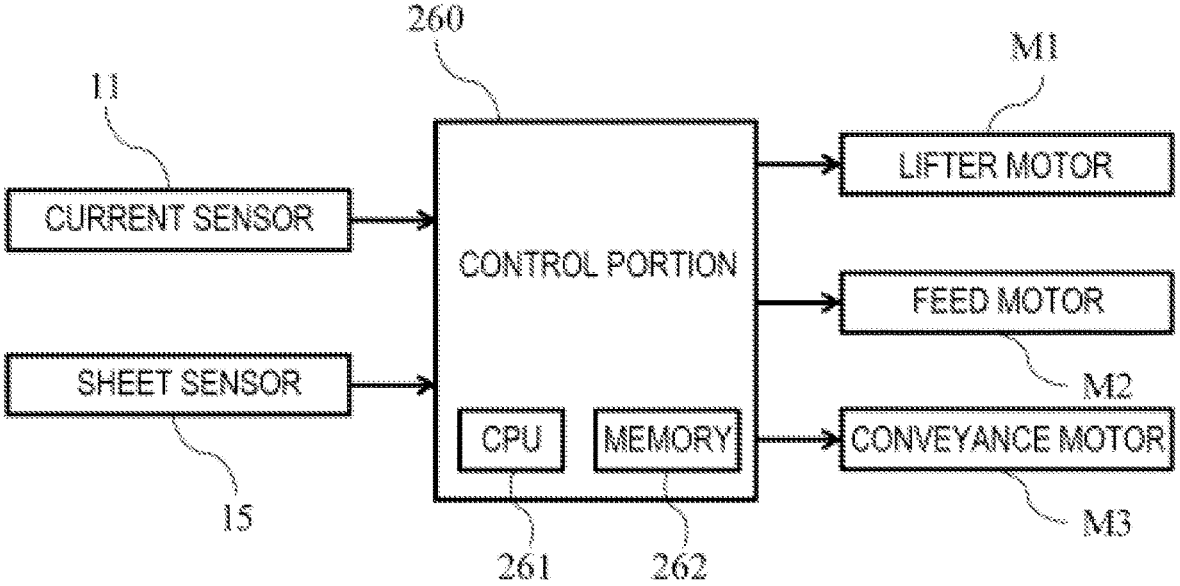
FIG. 12 is a block diagram for illustrating a control configuration for the sheet feeding apparatus according to the second embodiment.

In the second embodiment, a sheet sensor 15 is arranged. The sheet sensor 15 serves as a sheet detection unit configured to detect that a sheet has reached a conveyance roller pair 14 arranged downstream of the feed roller and the retard roller 10. As illustrated in FIG. 12, the sheet sensor 15 is connected to the control portion 260 together with the current sensor 11 configured to detect an input current with respect to the feed motor M2. The control portion 260 is configured to control drive states of the lifter motor M1, the feed motor M2, and a conveyance motor M3 configured to drive the conveyance roller pair 14 based on detection signals from the above-mentioned sensors.

As described above, when the sheet is conveyed, there is a case in which the stick-slip phenomenon occurs on contact surfaces between the last sheet and the friction member 6 or between contact surfaces of the sheets, and vibration thereof is amplified on, for example, a frame of the sheet feeding apparatus 230, with the result that noise is generated. It has been known that, when vibration caused by the stick-slip phenomenon occurs at one roller or in a vicinity of the roller, the vibration can be suppressed by reducing the drive force input to the roller. This is because of the following reason. When the drive is reduced, the influence of backlash (play) between members along a transmission path of the drive force from the drive source to the roller increases, with the result that the apparent rigidity of the configuration for holding the roller changes. In other words, even when a cyclical external force is applied to the roller, displacement of the roller is absorbed by the backlash, thereby being capable of suppressing propagation of vibration to the extent that noise is not sensed.

In the case of the second embodiment, as illustrated in FIG. 10, the drive force of the feed motor M2 is input to a drive shaft 9A of the feed roller 9 through intermediation of the drive transmission portion 17 such as a gear train or a belt transmission mechanism. Further, rotation of the drive shaft 9A is transmitted to the pickup roller 8 through intermediation of a transmission member such as an idler gear held by the roller holder 18. Thus, through reduction of torque output by the feed motor M2, vibration applied to the pickup roller 8 is more likely to be absorbed on the drive transmission path extending from the feed motor M2 to the pickup roller 8 through intermediation of the drive transmission portion 17 and the drive shaft 9A.

Incidentally, when the drive force of the roller configured to convey the sheet such as the pickup roller 8 is reduced, there is a fear in that the sheet conveyance performance is degraded to cause non-feeding of the sheet. Therefore, the control portion 260 performs control of reducing the drive force of the pickup roller 8 when the fluctuation of the drive load due to the stick-slip phenomenon is detected based on a detection signal from the current sensor 11.

Figure 11A:
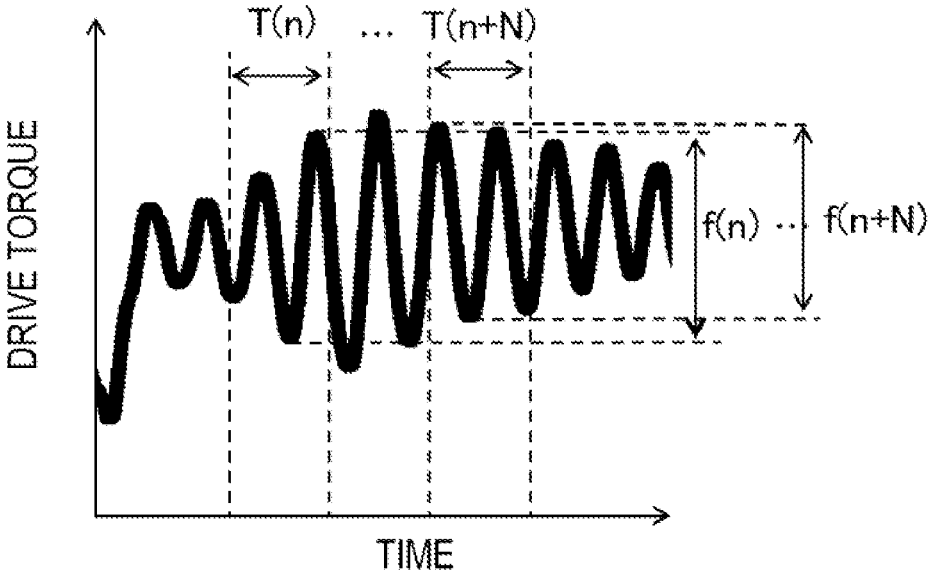
FIG. 11A is a graph for showing the amount of change in drive torque of a feed motor when the stick-slip phenomenon occurs.
Figure 11B:
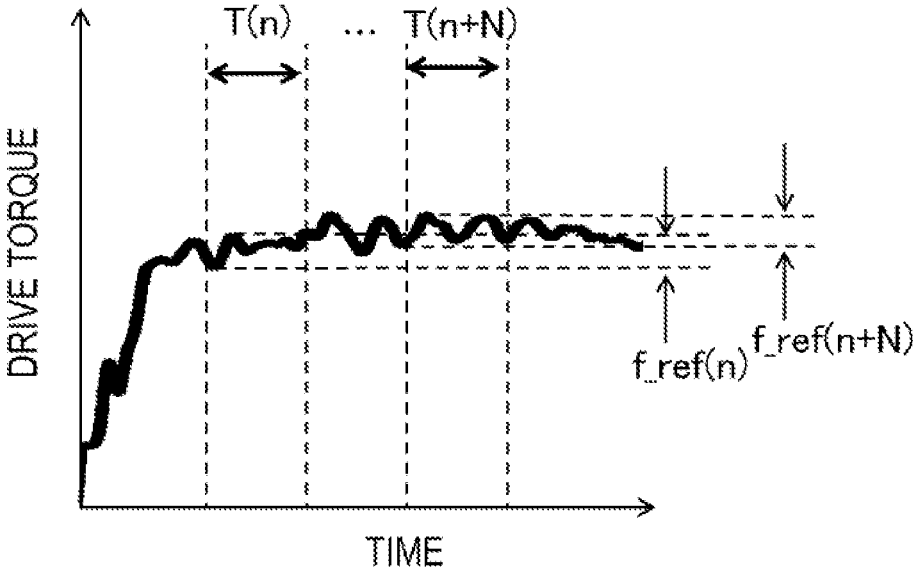
FIG. 11B is a graph for showing the amount of change in drive torque of the feed motor when the stick-slip phenomenon does not occur.

With reference to FIG. 11A and FIG. 11B, a description will be provided of a relationship between the stick-slip phenomenon and the fluctuation amount of the drive torque of the feed motor M2. It is known that, when the stick-slip phenomenon occurs between the last sheet and the friction member 6 or between the sheets, the drive torque of the feed motor M2 exhibits characteristics of vibration. FIG. 11A is a graph for showing an example of a test result of measurement of the drive torque in a case in which the stick-slip does not occur. FIG. 11B is a graph for showing an example of a test result of measurement of the drive torque in a case in which the stick-slip occurs. In FIG. 11B, the fluctuation band of the drive torque significantly increases and exhibits a behavior like vibration.

This is because the friction force which acts on the sheet fluctuates between a state in which the fed sheet sticks to the friction member 6 or another sheet (stick state) and a state in which the fed sheet slips relative to the friction member 6 or another sheet (slip state). As a result of the fluctuation of the friction force with respect to the sheet, the torque required for rotating the roller member forming the feed unit 13 cyclically fluctuates. In general, the torque output from the motor is determined by an input current value. When a DC motor is used, the output torque is proportional to the input current. Moreover, when a stepping motor is used, the relationship between the input current and the output torque can be considered as substantially proportional to each other through use of vector control.

Therefore, in the second embodiment, a current value of the feed motor M2 is acquired from the output of the current sensor 11, to thereby estimate the output torque (drive load) of the feed motor M2. When a state in which the fluctuation band of the torque exceeds a threshold value continues for a predetermined time period, it is determined that vibration of the apparatus has been detected, and the drive of the feed motor M2 is stopped after it is confirmed that the sheet P has arrived downstream at the conveyance roller pair 14.

A description will be provided of an example of algorithm for determination of presence or absence of vibration of the device with reference to FIG. 11A and FIG. 11B. As described above, when the vibration caused by the stick-slip phenomenon occurs, the state in which the fluctuation band of the torque is large continues. In view of this, a predetermined time period T for defining a width of a time window is set, and determination is made on whether or not f(n) which is a difference between a maximum value and a minimum value of torque in the n-th time window T(n) from the start of measurement exceeds a threshold value.

The predetermined time period T is set so as to satisfy T>Ta with respect to a vibration cycle Ta of the feed unit 13 to which the pickup roller 8 is provided. This is because, while it is known that most of the vibration number of the vibration due to the stick-slip matches a unique vibration number of that system, it is required to measure a time period longer than a cycle corresponding to the unique vibration number in order to measure its amplitude.

Moreover, the control portion 260 acquires in advance the fluctuation band of the torque given in a normal state in which the noise does not occur as a reference value f_ref(n), and stores the same in the memory 262. The control portion 260 uses a twofold of the reference value f_ref(n) as a threshold value, and determines whether or not the fluctuation band f(n) of the torque measured at the time of feeding of the sheet exceeds the threshold value. That is, when the following relationship is satisfied, the control portion 260 determines that the fluctuation band f(n) exceeds the threshold value.

$$f(n)>2\times f_\mathrm{ref}(n) \tag{7}$$

It is not preferable to determine that the vibration caused by the stick-slip phenomenon has occurred based only on the fact that the torque fluctuation band f(n) in the certain time window T(n) exceeds the threshold value. This is because it cannot be distinguished between a case in which the torque fluctuates due to a non-cyclic sudden event such as collision of the leading edge of the sheet against a guide and a case in which the stick-slip phenomenon actually occurs. In view of this, in the second embodiment, when the torque fluctuation band f(n) in the certain time window T(n) exceeds a threshold value, and the torque fluctuation band exceeds the threshold value successively for subsequent N-number of time windows, it is determined that the vibration caused by the stick-slip has occurred. That is, it is required that, in addition to the condition (7), the following inequality expressions be satisfied:

$$f(n+1)>2\times \mathrm{f_ref}(n+1),$$

$$f(n+2)>2\times \mathrm{f_ref}(n+2),$$

$$\cdots$$

$$f(n+N)>2\times \mathrm{f_ref}(n+N),$$

where N≥2 is satisfied.

Through such determination that vibration has been detected when the torque fluctuation exceeding the threshold value continuously occurs, the vibration due to the stick-slip phenomenon and the torque fluctuation which is sudden and not continuous can be distinguished. Any other analysis method may be employed as long as the method enables determination of presence or absence of the vibration unique to the stick-slip phenomenon while excluding accidental torque fluctuation from chronological data of torque. For example, a frequency component corresponding to the unique vibration number of the system may be extracted from the data as illustrated in FIG. 11A, and determination may be made that the vibration is detected when the magnitude of the frequency component exceeds a predetermined value.

Figure 13:
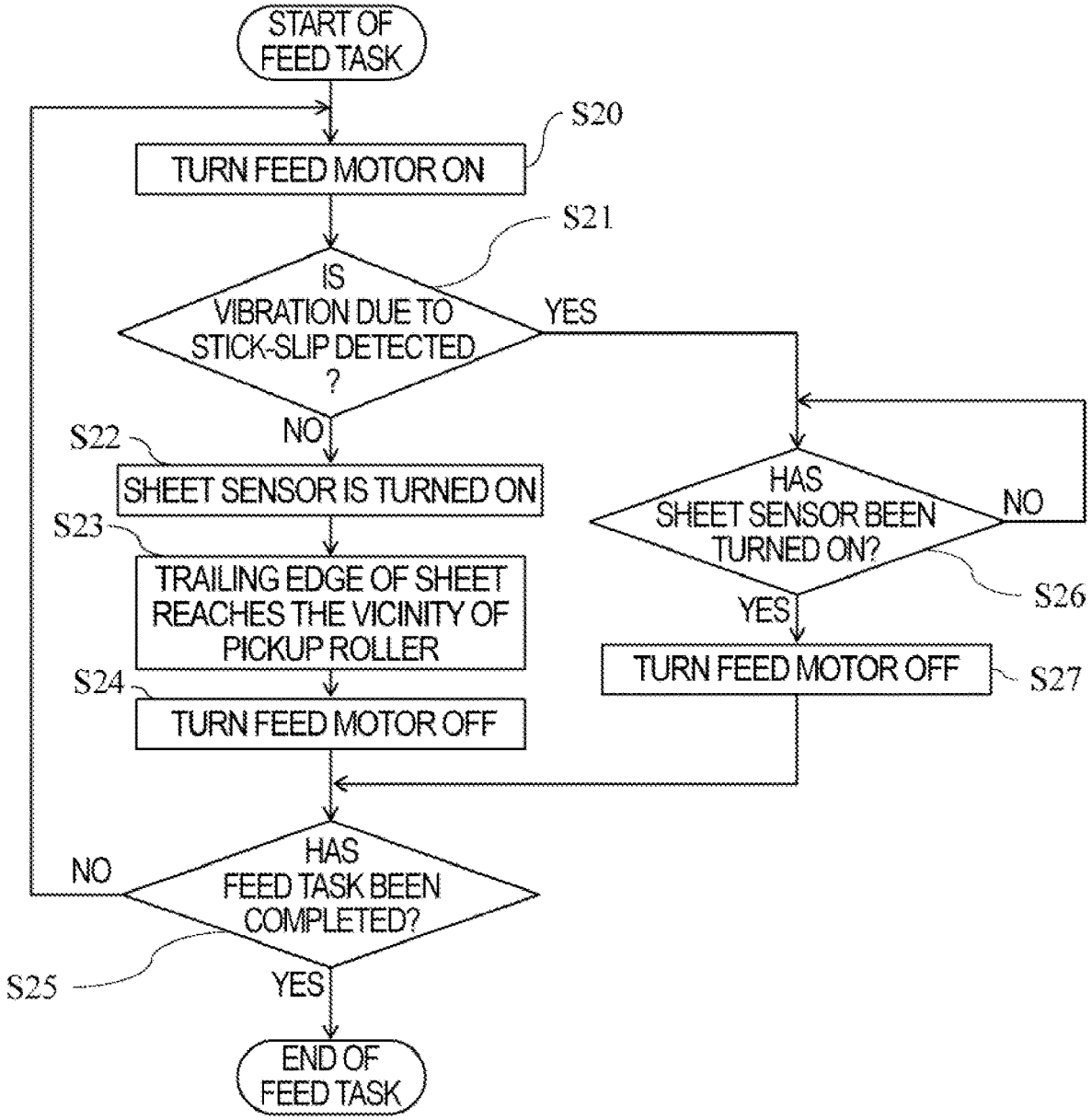
FIG. 13 is a flowchart for illustrating a control method for a sheet feeding operation in the second embodiment.

Now, a control method for the feed task in the second embodiment is described with reference to the flowchart of FIG. 13. When the feed task for the sheet is started, the control portion 260 starts drive of the feed motor M2 (Step S20), and determines whether or not vibration due to stick-slip occurs (Step S21). When the vibration does not occur (NO in Step S21), the feed motor M2 and the conveyance motor M3 are driven under normal control to convey the sheet P (Step S22 to Step S24). In this case, even when the sheet sensor 15 detects that the sheet has reached the conveyance roller pair 14 (Step S22), the drive of the pickup roller 8 by the feed motor M2 is continued. Then, in order to prevent feeding of the next sheet, the feed motor M2 is stopped at an appropriate timing before the trailing edge of the sheet passes through the pickup roller 8 (Step S23 and Step S24). The stop timing of the feed motor M2 is calculated, for example, based on size information of the sheets stacked on the feed cassette 1 and the feeding speed of the sheet. After that, determination is made on whether or not the feed task has been completed. When the feed task has been completed, the operation is ended (YES in Step S25). When the feed task has not been completed, processing for the next sheet is started (NO in Step S25).

Meanwhile, when it is detected that the vibration due to the stick-slip occurs based on the drive load of the feed motor M2 detected by the current sensor 11 (YES in Step S21), the control portion 260 performs the processing of turning off the drive of the pickup roller 8 by the feed motor M2. That is, the control portion 260 waits until the sheet reaches the conveyance roller pair 14 based on the detection signal from the sheet sensor 15 (NO in Step S26). When it is determined that the sheet has reached the conveyance roller pair 14 (YES in Step S26), the drive of the feed motor M2 is stopped (Step S27). At this time, the drive of the conveyance roller pair 14 by the conveyance motor M3 is continued, and the sheet is continuously conveyed to the image forming portion by the conveyance roller pair 14. After that, determination is made on whether or not the feed task has been completed. When the feed task has been completed, the operation is terminated (YES in Step S25). When the feed task has not been completed, the processing for the next sheet is started (NO in Step S25).

As described above, in the second embodiment, after feeding of the sheet is started, based on the detection result of the current sensor 11, control is performed so that the drive force transmitted from the feed motor M2 to the pickup roller 8 is reduced when the drive load of the feed motor M2 satisfies the predetermined condition. However, the predetermined condition in the second embodiment is determined as being satisfied when the fluctuation amount of the drive load of the feed motor M2 exceeds the predetermined value. With this, occurrence of noise due to the stick-slip phenomenon at the time of feeding the sheet can be reduced. Moreover, the feeding of the sheet is continued with a fixed drive force (first drive force) when the condition is not satisfied. Thus, the possibility of causing non-feeding of the sheet can be suppressed to minimum.

In particular, in the second embodiment, when the state with a large fluctuation of the drive load of the feed motor M2 continues for a predetermined period, it is determined that the vibration of the apparatus due to the stick-slip phenomenon has occurred. Therefore, the fluctuation of the drive load by accident and the fluctuation of the drive load due to the stick-slip phenomenon is distinguished, thereby being capable of suppressing to the minimum the case of reducing the drive of the pickup roller 8.

Moreover, in the second embodiment, at the time point at which the sheet has reached the conveyance roller pair 14 downstream of the pickup roller 8, the drive of the pickup roller 8 is stopped. In other words, in the second feed mode, the drive force transmitted to the feed member is reduced to zero under the state in which the sheet has reached the conveyance unit downstream of the feed member. With this, even when the vibration due to the stick-slip phenomenon occurs, the vibration can be sufficiently damped before the vibration is transmitted to, for example, the feed frame 19 of the sheet feeding apparatus 230, thereby being capable of more effectively suppressing occurrence of the noise.

Modification Example

In the second embodiment described above, control of turning off the drive of the pickup roller 8 (reducing the drive force to zero) is performed when the vibration of the apparatus is detected. However, the drive of the feed motor M2 may be continued by setting the output torque of the feed motor M2 at the time of detecting the vibration of the apparatus (second drive force) to a value smaller than the output torque at the time of start of feeding (first drive force). For example, the DC motor may be used as the feed motor M2, and the maximum value of the current flowing through the winding of the motor given when the vibration of the apparatus is detected may be limited to be smaller than that in the case in which the vibration of the apparatus is not detected. Moreover, in the second embodiment, the sheet sensor 15 is used to determine whether or not the sheet has reached the conveyance roller pair 14. However, for example, arrival of the sheet to the conveyance roller pair 14 may be determined based on, for example, the elapsed time from the start of drive of the feed unit 13 by the feed motor M2.

Another Embodiment

In the embodiments described above, a description was provided of the sheet feeding apparatus 230 (see FIG. 1) including the feed cassette which is removably mounted to the apparatus main body 201A of the image forming apparatus 201. However, the present technology may be applied to another sheet feeding apparatus. The manual-feed device 250 provided on the side surface of the image forming apparatus 201 is one example of such sheet feeding apparatus. The manual-feed device 250 includes a manual-feed tray 20 (sheet stacking unit) which is provided on the side surface of the apparatus main body 201A so as to be openable and closable, and is configured to separate and feed sheets set by a user on the manual-feed tray 20 one after another by the feed unit 130. Moreover, an original feeding device configured to feed sheets being originals in the image reading apparatus 202 is another example of the sheet feeding apparatus.

Incidentally, in order to determine occurrence of the stick-slip phenomenon or the possibility of occurrence of the stick-slip phenomenon, the magnitude of the drive load of the drive unit (feed motor M2) is set as a condition in the first embodiment, and the fluctuation band of the drive load is used as the condition in the second embodiment. Meanwhile, as a method of reducing occurrence of noise due to the stick-slip phenomenon, the conveyance speed of the sheet is switched in the first embodiment, and the drive force input to the feed member (pickup roller 8) is reduced in the second embodiment. Those elements may be used in combinations different from those of the first and second embodiments. For example, there may be employed a configuration in which the feeding speed is switched from low-speed to high-speed, for example, when the vibration of the apparatus is detected based on the fluctuation band of the drive load.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-190138, filed Sep. 29, 2017, which is hereby incorporated by reference herein in its entirety.

What is claimed is:

1. A sheet feeding apparatus comprising:

a sheet stacking unit having a sheet stacking portion on which sheets are stacked;

a feed roller configured to abut against an uppermost sheet of the sheets stacked on the sheet stacking portion to feed the sheet;

a friction member, made of an elastic material having a coefficient of static friction which is greater than a coefficient of static friction of the sheet stacking portion, disposed on the sheet stacking unit so as to be opposed to the feed roller, the friction member being arranged at a position such that the sheets are sandwiched between the feed roller and the friction member;

a drive unit configured to drive the feed roller;

a current sensor configured to detect current supplied to the drive unit; and a control unit configured to control the drive unit so that a feeding speed when feeding the sheets is a first speed, wherein in a case in which a last sheet of the sheets is fed, the control unit controls the drive unit, based on a value of the current detected using the current sensor while feeding the last sheet at the first speed, to drive selectively in a first mode in which the feeding speed continues at the first speed and a second mode in which the feeding speed is changed from the first speed to a second speed higher than the first speed.

2. A sheet feeding apparatus according to claim 1, wherein in the second mode, the control unit controls the drive unit to change the feeding speed of the feed roller to the second speed after temporarily stopping a drive of the drive unit.

3. A sheet feeding apparatus according to claim 1, wherein in the second mode, the control unit controls the drive unit to change the feeding speed to a third speed lower than the first speed after feeding the last sheet at the second speed.

4. A sheet feeding apparatus according to claim 1, wherein the control unit obtains a current value detected by the current sensor to determine an output torque of the drive unit, and in a case in which the determined output torque does not exceed a threshold value, the control unit controls the drive unit to drive in the first mode, and in a case in which the determined output torque exceeds the threshold value, the control unit controls the drive unit to drive in the second mode.

5. A sheet feeding apparatus according to claim 1, wherein the control unit obtains a current value detected by the current sensor to estimate an output torque of the drive unit, and in a case in which a state, in which a fluctuation band of the estimated output torque exceeds a threshold value, continues for a predetermined time period, the control unit controls the drive unit to drive in the second mode.

6. A sheet feeding apparatus according to claim 1, wherein the drive unit comprises a motor, and wherein the current sensor is configured to detect a magnitude of a current flowing through a winding of the motor.

7. A sheet feeding apparatus according to claim 1, further comprising an image forming unit configured to form an image on the sheet fed from the sheet stacking unit.

8. A sheet feeding apparatus comprising:

a sheet stacking unit having a sheet stacking portion, on which sheets are stacked, and which is raisable and lowerable;

a feed roller configured to abut against an uppermost sheet of the sheets stacked on the sheet stacking portion to feed the sheet;

a friction member, made of an elastic material having a coefficient of static friction which is greater than a coefficient of static friction of the sheet stacking portion, disposed on the sheet stacking unit so as to be opposed to the feed roller, the friction member being arranged at a position such that the sheets are sandwiched between the feed roller and the friction member;

a drive unit configured to drive the feed roller;

a detection unit configured to detect a load on the drive unit when the drive unit drives the feed roller;

a lifter motor configured to move the sheet stacking portion;

an adjustment unit configured to move the sheet stacking portion by using the lifter motor and adjust an abutment pressure between the feed roller and the sheet stacked on the sheet stacking portion; and a control unit configured to control the drive unit, so that the control unit causes the drive unit to start to drive the feed roller in a state in which the feed roller abuts against the sheet at a first abutment pressure and thereafter in a case in which the load detected by the detection unit satisfies a predetermined condition, the control unit controls the adjustment unit so that the feed roller is brought into a state in which the feed roller abuts against the sheet at a second abutment pressure lower than the first abutment pressure.

* * * * *